US007137152B2

(12) United States Patent
Smith

(10) Patent No.: US 7,137,152 B2
(45) Date of Patent: Nov. 21, 2006

(54) BIRD-CAP ASSEMBLY

(76) Inventor: Brandon Smith, 4748 N. Carlisle St., Philadelphia, PA (US) 19141

( * ) Notice: Subject to any disclaimer, the term of this patent is extended or adjusted under 35 U.S.C. 154(b) by 0 days.

(21) Appl. No.: 11/219,450

(22) Filed: Sep. 2, 2005

(65) Prior Publication Data

US 2006/0048281 A1 Mar. 9, 2006

Related U.S. Application Data

(60) Provisional application No. 60/607,355, filed on Sep. 3, 2004.

(51) Int. Cl.
*A42B 1/24* (2006.01)

(52) U.S. Cl. ..... 2/209.13; 2/10; 2/422; 2/195.1

(58) Field of Classification Search ..... 2/209.13, 2/10, 422; 446/27
See application file for complete search history.

(56) References Cited

U.S. PATENT DOCUMENTS 1,776,175 A * 9/1930 Wittekind ..... 446/27
4,546,496 A * 10/1985 Lewis ..... 2/171.3
4,586,280 A * 5/1986 Dane ..... 40/329
5,167,559 A * 12/1992 Power-Fardy ..... 446/27
5,462,471 A * 10/1995 Power-Fardy ..... 446/26
5,533,207 A * 7/1996 Diaz ..... 2/10
5,781,934 A * 7/1998 Pauley, Jr. ..... 2/209.13
6,500,041 B1 * 12/2002 Crome, Jr. ..... 446/27

* cited by examiner

*Primary Examiner*—John J. Calvert
*Assistant Examiner*—Richale L. Haney
(74) *Attorney, Agent, or Firm*—Eugene E. Renz, Jr.

(57) ABSTRACT

The combination comprising a figure element mounted on the bill of a cap. The figure element includes a removable compartment and the mounting means comprises an elongated threaded screw member having an enlarged head at one end engageable through a hole in the bill. A washer is disposed between the screw head and the bill. An enlarged tapered flexible ring is mounted between the outer surface of the bill and the bottom compartment. A lock washer threads on the shank of the screw remote from the head end. The flexible ring permits limited turning of the compartment when the screw is turned to a locked position to facilitate assembly and disassembly of the compartment from the figure element.

3 Claims, 4 Drawing Sheets

BIRD-CAP ASSEMBLY

This application claims the benefit of Provisional Application Ser. No. 60/607,355, entitled, BIRD CAP, filed Sep. 3, 2004.

FIELD OF THE INVENTION

The present invention relates to a novel bird-cap assembly and more specifically to an improved mounting arrangement for securing a flapping bird to the bill of the cap.

BACKGROUND OF THE INVENTION

Sport fans particularly football fans have devised colorful wearing apparel which may be characterized as costumes featuring a given teams' logo and colors. These costumes include mascots such as bears and eagles which are worn by enthusiastic fans at game day in the stadiums. Caps and shirts with the team logos emblazoned thereon are likewise commonplace. Thus, the prior art includes caps broadly and in the present instance, a mechanized eagle which is battery powered to flap the wings of the eagle.

SUMMARY OF THE INVENTION

The present invention combines the eagle and the cap in an unique mounting arrangement which facilitates easy and economical assembly of the flapping bird to the bill of a cap and is positioned in such a manner to provide an interesting appearance. The mounting arrangement is of simplified construction and supports the eagle in such a manner so that it is positioned not to interfere with the cap when it is worn by a user. The mounting arrangement includes elements for securely positioning the flapping eagle in place and yet is easy to disassemble when it is desired to wear the cap without the eagle mounted thereon. Thus, the mounting assembly includes an elongated screw and a flexible spacer which engages between cap and battery compartment slidably mounted in the underbelly of the eagle and which is normally secured thereto by a screw fastener. The flexible spacer ring permits limited angular movement of the eagle to a skewed position to facilitate turning the screw fastener, mounting the compartment and rotation of the eagle to its normal mounted position aligned with the bill of the cap as shown in FIG. 1.

BRIEF DESCRIPTION OF THE DRAWINGS

These and other objects of the present invention and the various features and details of the operation and construction thereof are hereinafter more fully set forth with reference to the drawings wherein.

DESCRIPTION OF THE PREFERRED EMBODIMENTS

Figure 1:
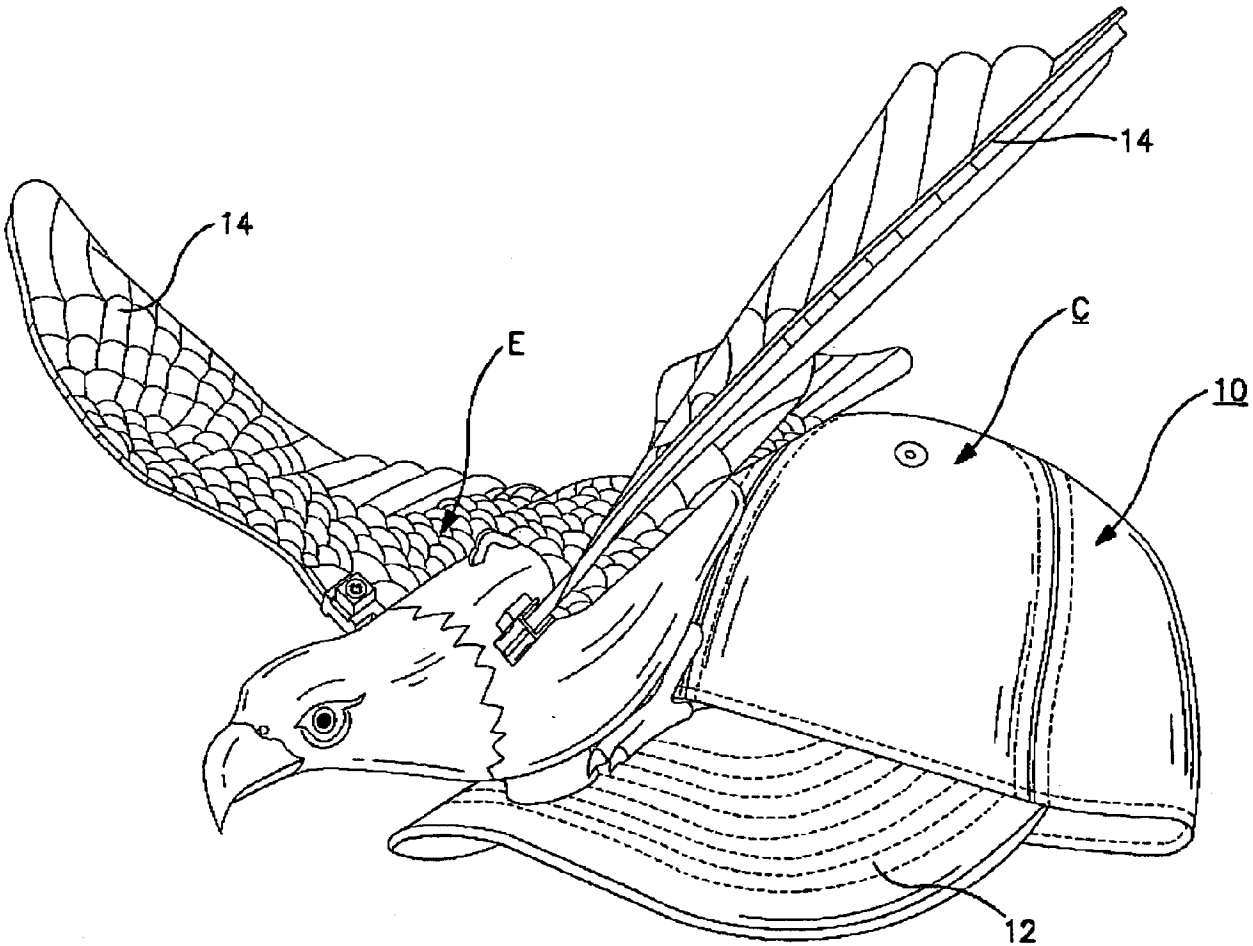
FIG. 1 is a perspective view showing the flapping eagle mounted on the bill of a cap.
Figure 2:
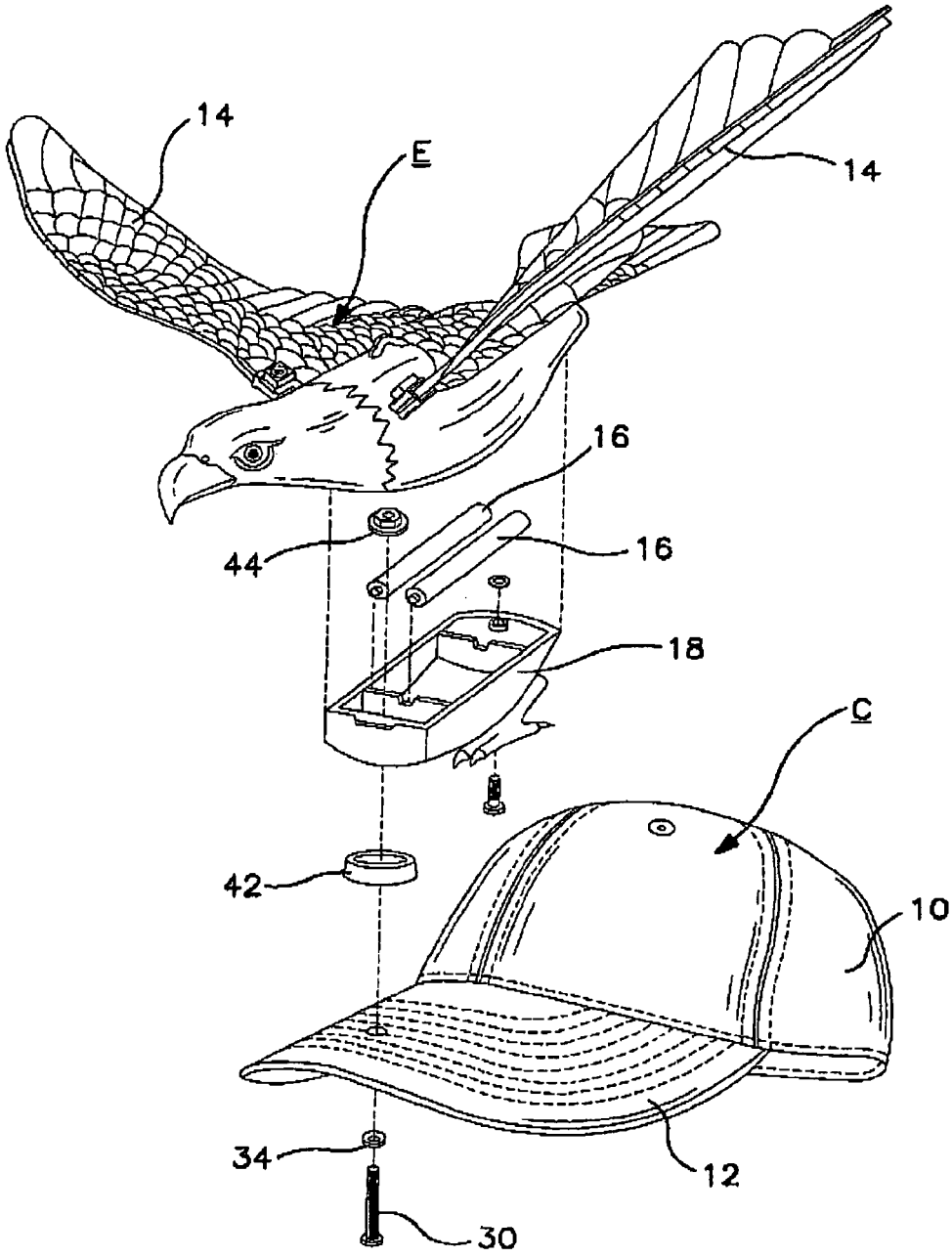
FIG. 2 is an exploded perspective view showing the details of the underbelly of the eagle and the mounting arrangement for positioning for mounting the eagle in place.

Referring now to the drawings and particularly to FIGS. 1 and 2 thereof, the basic combination comprises a conventional baseball cap C having a portion 10 which fits the head of the user and an elongated curved bill 12 and a figure element in the present instance, an eagle E which is battery powered and thus can be activated to flap the wings 14 of the eagle. The batteries 16 are housed in a removable compartment 18 slidably mounted in the underbelly of the eagle E. The battery compartment 18 is held in place in the locked or closed position by a headed screw 20 which engages through a hole 22 in the curved bottom wall 24 of the compartment 18 and threadedly engages a lock nut 26 mounted in the underbelly 28 of the eagle E as shown in FIG. 4. The battery housing as illustrated slides into the underbelly of the eagle and has a slightly curved base or bottom wall 24. Accordingly, when the eagle is mounted on the bill of the cap, it is pitched forward slightly as shown in FIG. 1 and the tail is tilted upwardly so that it does not interfere or press against the cap portion of the cap in the manner shown in FIGS. 1 and 3 as explained in more detail below.

Figure 3:
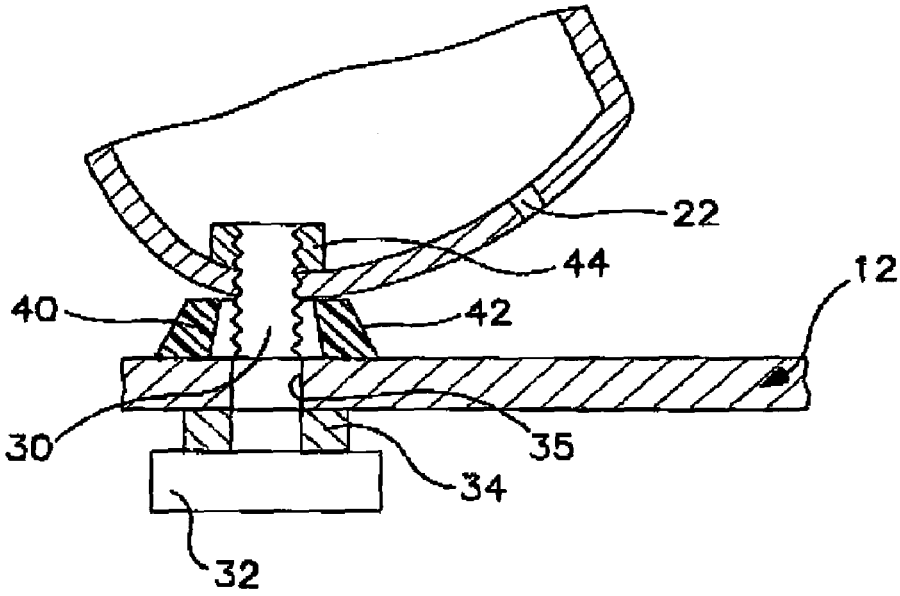
FIG. 3 is a fragmentary sectional view showing the hole in the curved bottom wall of the battery compartment to position the mounted eagle at a slightly downwardly facing attitude so that the rear portion of the eagle clears the cap portion of the cap.
Figure 4:
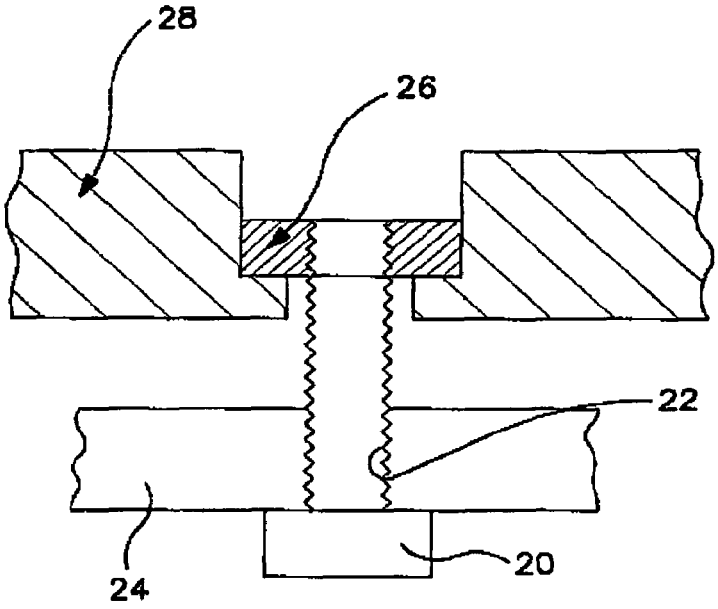
FIG. 4 is a fragmentary sectional view showing the screw fastener and lock washer mounted in the body portion of the eagle to secure the battery compartment in a closed nested position.

The sole mounting means for mounting the eagle E on the bill of the cap C comprises as best illustrated in FIGS. 2 and 3 an elongated externally threaded screw 30 having an enlarged head 32, a washer 34 which engages between the head 32 of the screw and the underside of the cap bill 12 and which is of a diameter D greater than the hole 35 in the bill of the cap. An enlarged flexible ring 40 having downwardly and outwardly tapered sidewalls 42, preferably made of a resilient material, such as rubber, is positioned to engage the outer surface of the bill of the cap and the underside of the battery housing in the manner shown in FIG. 3. A lock nut 44 engages interiorly of the battery compartment 18 so that when the screw is turned in a manner to lock the eagle to the cap, the resilient ring 40 provides a degree of play yet secures the assembly and locks the eagle securely in place in the manner shown.

Considering now briefly assembly of the eagle to the cap, the battery housing 18 is removed from the body 28 of the eagle E which allows access and then the screw 30, first washer 34, and resilient ring 40 are positioned in place and secured to the battery housing simply by rotating the screw into lock nut 44.

The compression ring 40 permits limited rotation of the eagle E relative to the cap to a skewed position about 90° to its normal mounting position so that the screw 20 holding the battery compartment 18 to the body of the eagle E can be turned to mount the battery compartment 18 in the eagle E in the manner described above.

Even though particular embodiments of the present invention have been illustrated and described herein, it is not intended to limit the invention and changes and modifications may be made therein within the scope of the following claims.

The invention claimed is:

1. The combination of a figure element mounted on the bill of a cap wherein the figure element includes a removable compartment, a mounting means comprising an elongated threaded screw member having an enlarged head at one end engageable through a hole in the bill and an opening in the figure element compartment, a washer between the screw head and the bill, a flexible rubber ring between the outer surface of the bill and removable compartment and a lock washer threaded on the shank of the screw remote from the head end, wherein the frictional forces between the ring and bill's outer surface provides limited angular turning movement of the compartment to facilitate precise positioning of the figure element on the bill of the cap when the screw is in a locked position.

2. The combination of a figure element mounted on the bill of a cap wherein the figure element includes a removable compartment, a mounting means comprising an elongated threaded screw member having an enlarged head at one end engageable through a hole in the bill and an opening in the figure element compartment, a washer between the screw head and the bill, a flexible ring having inner and outer flat axial end faces confronting and engaging the outer surface of the bill and removable compartment and a lock washer threaded on the shank of the screw remote from the head end, wherein the frictional forces between the ring and bill's outer surface provides limited angular turning movement of the compartment to facilitate precise positioning of the figure element on the bill of the cap when the screw is in a locked position.

3. The combination of a figure element mounted on the bill of a cap wherein the figure element includes a removable compartment, a mounting means comprising an elongated threaded screw member having an enlarged head at one end engageable through a hole in the bill and an opening in the figure element compartment, a washer between the screw head and the bill, a flexible ring having inner and outer flat axial end faces confronting and engaging the outer surface of the bill and removable compartment and a lock washer threaded on the shank of the screw remote from the head end, wherein the frictional forces between the ring and bill's outer surface provides limited angular turning movement of the compartment to facilitate precise positioning of the figure element on the bill of the cap when the screw is in a locked position, said flexible ring being tapered so that the surface area of the inner axial end face is greater than the surface area of the outer axial end face.

* * * * *